United States Patent [19]

Johnson

[11] Patent Number: 4,557,099

[45] Date of Patent: Dec. 10, 1985

[54] METHOD OF CONSTRUCTING FOLDABLE CONCRETE SLAB BUILDINGS WITH ACCESS SLOTS THRU CEILING SLABS FOR INSTALLING HINGEABLE CONNECTORS

[76] Inventor: Delp W. Johnson, 240 Oakview Dr., San Carlos, Calif. 94070

[21] Appl. No.: 519,082

[22] Filed: Aug. 1, 1983

[51] Int. Cl.[4] ..... E04B 1/344; E04G 21/14

[52] U.S. Cl. ..... 52/745; 52/125.1

[58] Field of Search ..... 52/745, 69–71, 52/122.1, 125.1–125.6, 236.3

[56] References Cited

U.S. PATENT DOCUMENTS

| | | | |
|---|---|---|---|
| 3,494,092 | 2/1970 | Johnson et al. | 52/745 |
| 3,744,196 | 7/1973 | Weese | 52/79.5 X |
| 3,828,512 | 8/1974 | Johnson | 52/79.5 X |
| 3,855,744 | 12/1974 | Miram | 52/125.5 |
| 3,968,618 | 7/1976 | Johnson | 52/69 |
| 4,437,272 | 3/1984 | Johnson | 52/71 |

*Primary Examiner*—J. Karl Bell

[57] ABSTRACT

Method is disclosed for construction of foldable constructed concrete slab buildings, in which method wall slabs for each floor level of the proposed building, are cast on site in horizontal layers, and groups of wall slabs are cast in stacks, with hinged edges of the wall slabs arranged according to the plan of the walls in the proposed building, and modular sections of ceiling slabs are cast near by in continuous array, and access slots are cast thru said ceiling slabs, and said access slots are arranged according to locations of the walls in the proposed building, and a lifting apparatus lifts a section of a ceiling slab and places it on top of a related group of wall slabs, and a connection device is inserted downward thru each of the access slots to engage the hinge edge of a wall, and said device being of the type that permits the hinge edge of the wall slab to rotate freely under the underside of the ceiling slab, and the ceiling slab is lifted, and the walls depend downward to a vertical position forming a module, and the module so formed is lifted into position in the proposed building, and the walls are lowered onto a supporting surface, and the ceiling slab is lowered down onto the hinge edge of the wall slabs, and the assembly is secured together, and the above sequence is repeated until all the layers of ceiling slabs and layers of wall slabs have been lifted to form a completed building.

17 Claims, 14 Drawing Figures

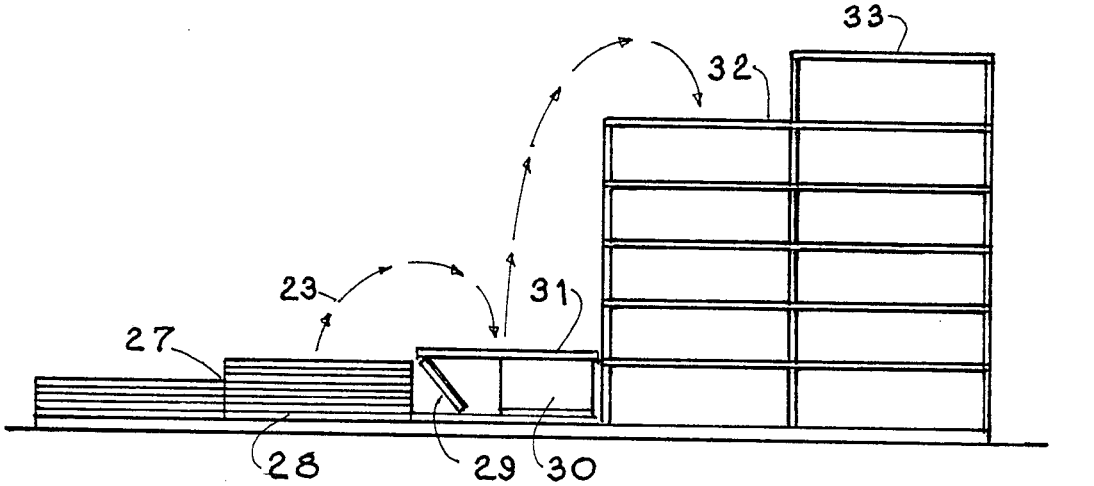
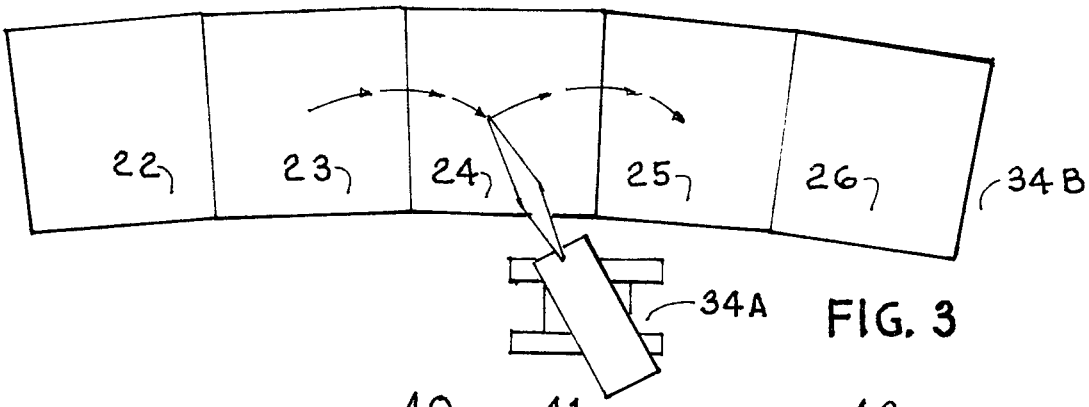
FIG. 3
FIG. 4
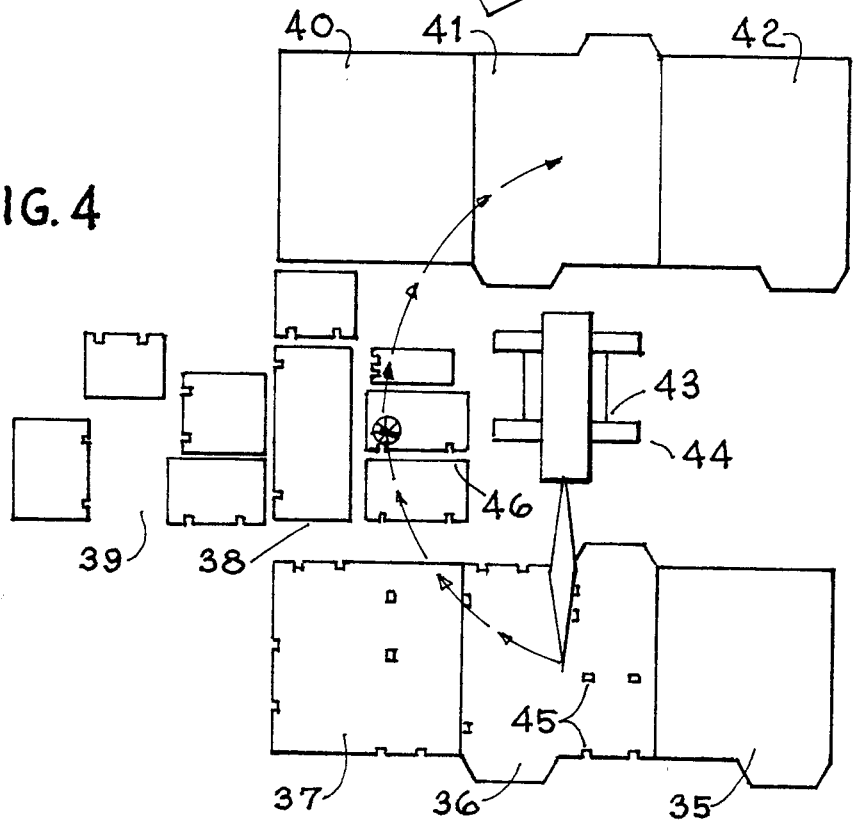

METHOD OF CONSTRUCTING FOLDABLE CONCRETE SLAB BUILDINGS WITH ACCESS SLOTS THRU CEILING SLABS FOR INSTALLING HINGEABLE CONNECTORS

BACKGROUND OF THE INVENTION

This method of construction relates to that method of construction in which wall slabs and ceiling slabs are cast on site in horizontal array, and sections of ceiling slabs are connected to related groups of wall slabs by hingeable connectors, and such sections are lifted causing the connected walls to depend to a vertical position to form modules for the proposed building, and in particular the present invention discloses a new method of arranging the casting of the wall slabs and the ceiling slabs, and a new method of assembling the walls and the ceiling slabs to form mocules thru the use of access slots provided in the ceiling slabs thru which hingeable type connectors can be inserted to connect the ceiling slabs to the wall slabs.

Heretofore, buildings have been constructed according to the teaching of Johnson U.S. Pat. No. 3,494,092 in which modules comprising sections of ceiling slabs and related wall slabs extending outwardly from said sections were cast horizontally on site, with a layer of each floor level of the proposed building. The outwardly extended walls caused the module to occupy an excessively large amount of site area, and the walls prevented ceiling sections from being cast adjacent to one another, resulting in mismatches when the modules were erected into the building. In addition the outwardly extended walls interferred with placement of balconies in the design, since they could only be located where a window occurred.

An improved method was disclosed in the teaching of Johnson U.S. Pat. No. 3,828,512 in which a layer of wall slabs was cast overlying the floor slab of the proposed building, and a ceiling slab was cast overlying the layer of wall slabs, with integrally cast hingeable devices connecting the ceiling slab and hinged edge of the wall slabs. This method has the disadvantage of requiring a false forming to fill the area between edges of wall slabs to provide a casting surface for the overlying ceiling slabs, and this is a costly, time consuming operation, and the remnants of the false forming frequently stick to the edges of the wall slabs and interfer with a good seating in the erected building. In addition the connecting devices, being integrally cast with the concrete, are subject to being knocked out of position, interfer with the finishing of the concrete wall slabs, and, if they are knocked out of line, or are jammed with grout, are imposible to correct, and this condition results in very bad lifts of the modules.

Greenhalgh U.S. Pat. Nos. 3,527,008 and 3,600,870 discloses "bolts with hollow bore: thru which cables are extended to be connected to edges of underlying wall panels, with overhead winches adapted to wind up the cable and bring the edge of the wall up to the overhead ceiling panel. This requires access to the underside to effect the connection of the cable to the edge of the panel for the wall and is suitable only for exterior wall panels where there is access with the "bolts with hollow bore" being located along an outside edge.

Now in the evolution of the constructing of buildings with precast wall and ceiling slabs, the hinged connections evolved to avoid problems of matching connections between separately cast elements, and the integrally cast hinge contributed to the economy and the speed of this method of construction; and there are patents disclosing bendable metal connectors and flexible nylon ropes to effect the connections. However, they still have the basic disadvantages of being subject to being cast out of position with no way to remedy. This is less of a problem in the United States than it is a problem where unskilled labor is used to construct the units.

In addition, the above teachings show walls cast in relation to ceiling slabs where forming must be repeated for each layer. This gives room for error and requires excessive labor. In addition, the false forming is a wasteful operation.

It is the object of the present invention to provide the means of gang casting the wall elements and gang casting the ceiling elements, with the means of hingeably connecting them through access slots provided in the ceiling slabs which provide some tolerance for workman accuracy and also to eliminate the need for false forming. It is a further object of this invention to utilize the access slots to develop through the slab continuity between floor levels of the building. It is a further object to disclose the arrangement of the on site casting operation in a manner to require a minimum of site under varying conditions, and an arrangement in which a minimum movement is required for the lifting apparatus during the erection of the building.

It is a further object of this invention to disclose the means of making the section line between adjacent modules, independent of the location of the walls, and in fact developing the means of dividing the ceiling slabs at the location of "0" moment and the development of a continuous slab over a bearing wall and hence the possibility of longer spans or thinner ceiling slab thicknesses.

A further objective of the present invention is to disclose how the teaching of Johnson '775 can be effectively used to provide depressed corridor area, modeled balcony walls, and enriched architectural design, when combined with the teaching of the present invention.

SUMMARY OF THE INVENTION

Briefly, a, method of on site casting stacks of wall slabs and nearby stacks of ceiling slabs, both stacks near the foundation slab for the building, and providing access slots thru the ceiling slabs so that when the ceiling slabs are lifted over a group of wall slabs, connections devices can be inserted down thru the ceiling slabs to engage the hinge edges of the wall slabs, and the assembled ceiling slab with its wall slabs elevated to form a module which is placed upon the foundation slab. Successive layers of ceiling slab sections are lifted with their related wall sections until the building is erected. The stacks of walls and ceiling slabs are so located as to minimize the movement of the lifting apparatus. Walls are lifted simultaneously and are closely coupled with the ceiling slabs so that the position of the wall is under control at all times. Walls may be cast underlying a ceiling section or may be cast extending outward beyond the edge of the ceiling slab, and an underlying cast wall combined with an outward cast wall may be used to form a corner.

BRIEF DESCRIPTION OF THE DRAWINGS

FIG. 3 shows a different arrangement of the cast slabs with the ceiling slabs cast on top of a casting platform constructed on top of groups of the wall slabs. This form of casting arrangement may be combined with the lifting arrangement shown in FIG. 1, which would avoid casting the walls overlying the foundation floor slab.

FIG. 4 shows another arrangement of the casting arrangement and shows the relation of the crane for this configuration. This requires more room, and more casting bed, but can shorten construction time.

DESCRIPTION OF THE PREFERRED EMBODIMENTS

Figure 1:
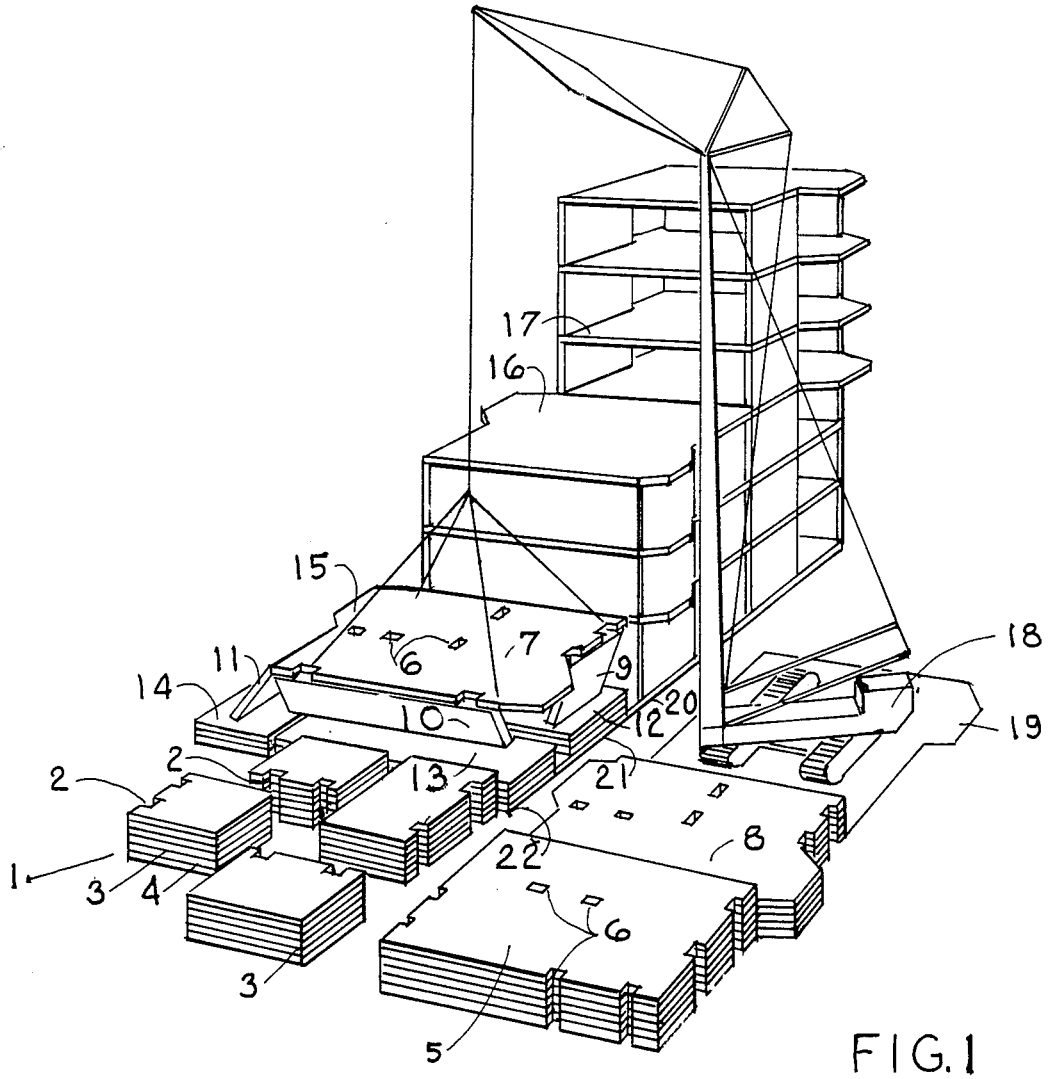
FIG. 1 discloses stacks of groups of wall slabs located on top of part of the foundation floor slab of the building, and a stack of ceiling slabs located nearby, and a crane has lifted a ceiling slab over a group of wall slabs, connections have been made thru the access slots, and the crane is elevating the module so formed to place it in the building.

Referring to FIG. 1, a group 1 comprising four stacks of wall slabs is shown with hinge edges 2 arranged according to the plan of the wall locations in the proposed building. Each layer of wall is identical with the layer below, and may be formed with a single gang form extending from the bottom to the top of the stack. This technique of forming assures square edges for the walls, and eliminates duplication of layout time. The surface 4 may be made irregular to provide additional keying for shear. Adjacent to the wall stacks 1, are cast the stack 5 of ceiling slabs with access slots 6 cast in locations corresponding to the plan locations of the walls. Ceiling slab 7 has been lifted from its cast position 8, and connecting devices have been inserted thru the access slots to connect slab 7 to walls 9,10, and 11 (other walls are concealed under slab 7), shown partially lifted from their cast positions 12, 13, and 14. Note that wall 11 is cast extending outward beyond edge of ceiling and in combination with wall 10 forms a corner for the module 15 which will be placed on top of module 16, and slab 7 will be secured to slab 17 in the erected structure. The crane 18 is shown at the location in line with the line between 15 and 16. From this position, the crane is able to lift the ceiling section to the assembly position, and continue on to the erected position without relocating the crane. After lifting all of the ceiling slabs 8 with the related walls from stacks 12, 13, and 14, the foundation floor area 21 will be empty, and the area occupied by ceiling slabs 8 will be empty, and the crane can move forward to line 22, from which it can be proceed to erect the ceiling slabs 5, in combination with the wall slabs at 1, to form more modules which will be erected in the area 21. To be emphasized is the fact that the hinged connector device is installed after the slabs have been cast and avoid the problems experienced with the cast in place connectors. False forming is eliminated; walls can be cast extending outward beyond the edge of the slab. And the layers of walls and ceilings can be cast identical without duplication of layout and forming. Access slots in layers of ceiling slabs are cast directly over one another, and vertical gang forming may be used for wall and ceiling slabs. The access slots also provides access to the hinges that would otherwise be inaccessible as in '512.

Figure 2:
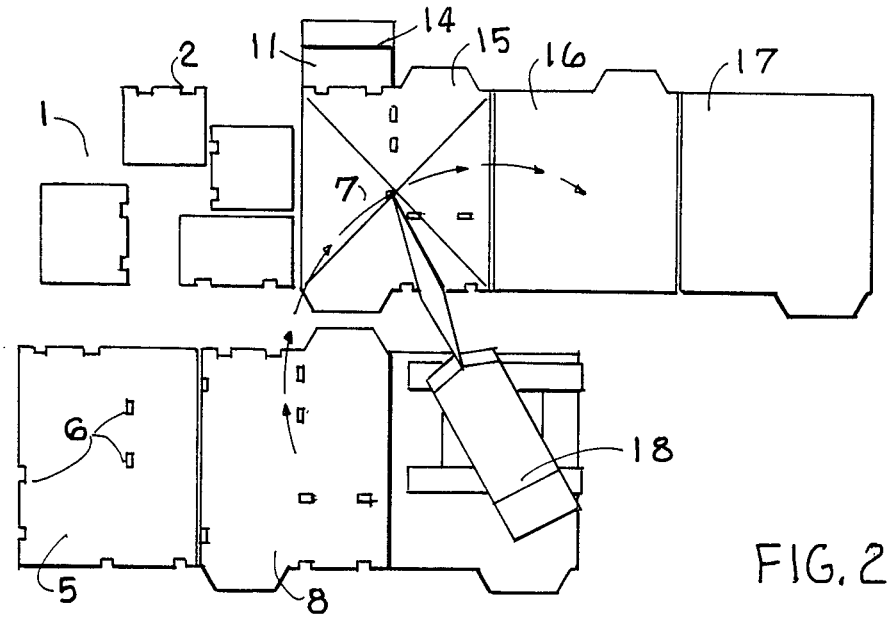
FIG. 2 shows the plan view of the perspective in FIG. 1.

FIG. 2 shows the plan view of FIG. 1, and discloses the open area between stacks of wall slabs where false forming is not required in the present invention. This Fig also shows the wall 14 cast extending beyond the edge of the ceiling slab. It should be noted that the wall slabs are shown with the notches at locations aligned with the access slots. It is not required that these be slots, and the connection of the hinge device to the wall may be by means of a metal connection attached to a bracket or channel.

FIG. 3 shows a stack of ceiling slabs 22 cast on ground level at the end of a stack of wall slabs 28. On top of slabs 28, is a casting platform 27, on top of which are additional ceiling slabs 23. Ceiling slab 31 was lifted from stack 23 on top of stack of wall slabs 30 where connector devices were inserted thru access slots to engage walls 29, and then slab 31 was elevated. This module will be lifted to position 32. One additional module will be lifted to bring this tower one module higher than 33. Crane shown at 34A could be located at 34B, and the entire building erected by erecting the building alongside the area where cast. The present invention takes advantage of the fact that the crane capacity required to erect an assembled module, is able to reach twice as far to pick up half the total weight, that is involved with just lifting the ceiling slab. In one sense, the present method resembles an assembly line with the modules moving forward as they are assembled and erected into the proposed building structure.

Referring to FIG. 4, an arrangement is shown suitable for a large open area where there is much casting room, or where adjacent buildings are spaced apart as the distance between 35 and 42, in which one building area serves as the casting area for the slabs in the adjacent building. As shown, ceiling slabs from 35 have been connected to wall slabs and erected in tower at 42.

Ceiling slabs from 45 are being combined with wall slabs from 38, and lifted into place at 41. Crane 43 operating from area 44, can operate from one location to complete the assembly and the erection and will then move forward. Connnectors are inserted thru access slots 45 to engage the wall slabs at location 46 before lifting. This position of the crane maximizes the lifting capability of the crane sin e the lifting radius is the minimum.

Figure 5:
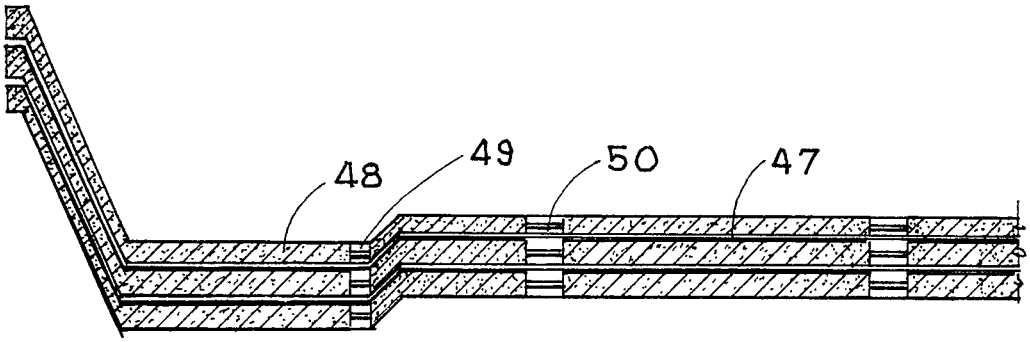
FIG. 5 shows a section thru a stack of "nested" slabs, showing how each slab can serve as a mold for the next above slab. This also shows the alignment of the access slots.

FIG. 5 shows the ceiling slabs 47 cast in a nested configuration with slab 48 lower than the main slab 47. This form of casting would be impossible to do with the prior art since the wall slabs and the ceiling slabs would interfer with one another. Access slots 49 are shown in cross section with a steel reinforcing bar extending across the slot. Access slot 50 is shown in longitudinal section.

Figure 6:
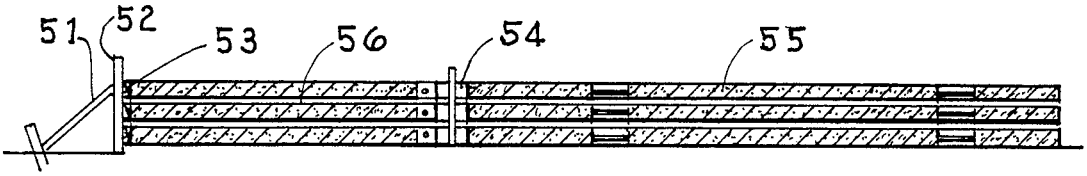
FIG. 6 shows stacks of wall slabs.

In FIG. 6, wall slabs 55 and wall slabs 56 are shown in stacked position. One type of forming with vertical posts 52 braced by 51, and a series of form boards 53 placed as each layer is cast. Block form 54, may be aligned on a pipe to hold them in position between stacks. Blockouts for ducts can be similarly formed, avoiding the problems of attaching to an adjacent slab as in the overlying/underlying method of '512.

Figure 7:
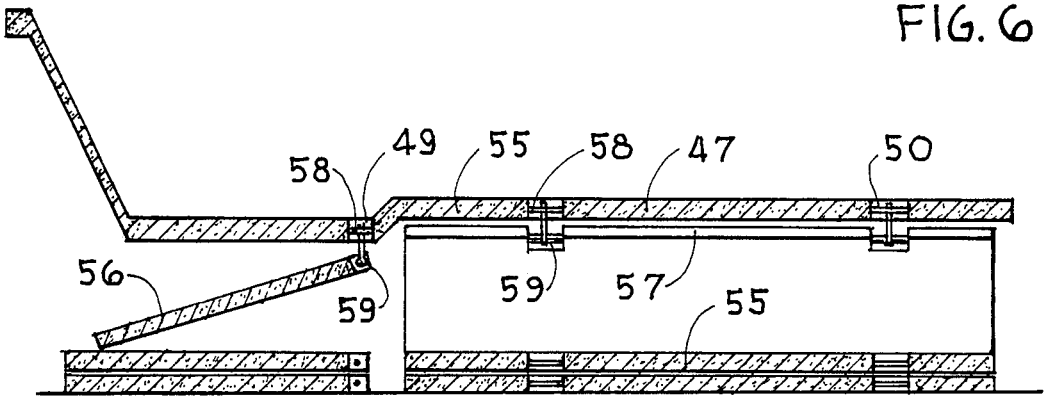
FIG. 7 shows the ceiling slab lifting the top layer of wall slabs from their stacks, with the lifting device inserted through the access slots.

In FIG. 7, slab 47 has access holes 49 and 50 thru which connectors 58 have been inserted to engage pivot 59 located in notches in edge 57 of wall slab 55. The lifting device 58 is supported by the sides of access slot 49 to maintain the position of the connector as the erection is completed and the ceiling slab is lowered down onto the edge 57 of the wall slab.

Figure 8:
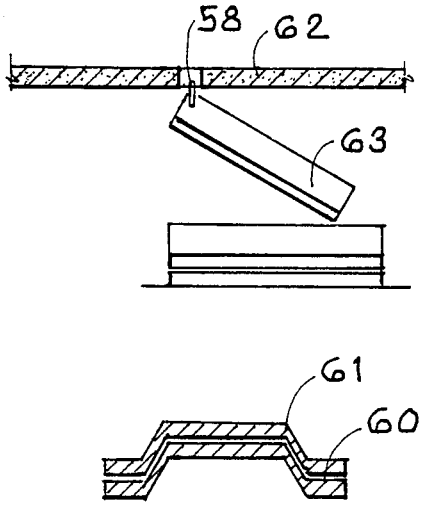
FIG. 8 shows a "nested" wall slab being lifted.

FIG. 8 discloses walls 60 and 61 cast in a nested position, and also shows slab 62 being lifted with connector 58 elevating hinge edge of slab 63. It should be noted that such lifts do not pass thru the center of gravity of 63, and hence the bottom foot edge of 63, will have to be moved over and supported as the ceiling slab is lowered onto slab 63.

Figure 9:
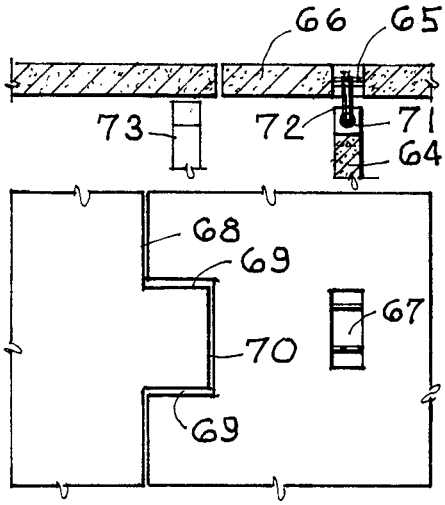
FIG. 9 shows a section line located a distance away from a supporting wall, producing the effect of a continuous span of the ceiling slab over the wall. It also shows the dividing line offset to facilitate structural joining of the two sections of ceiling slabs. These sections are cast together, so that a positive match is assured during erection.
Figure 10:
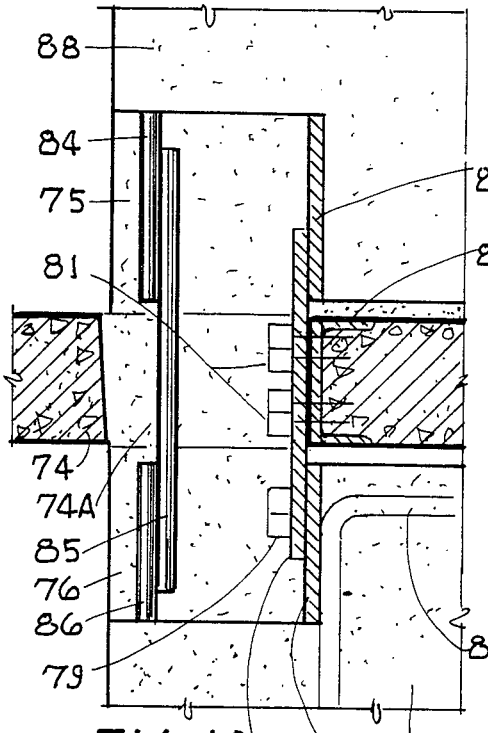
FIG. 10 shows a fragmentary section through an access slot with notches provided in the corners of the wall slabs above and below the ceiling slab, and a shear block of concrete cast into the notches and through the access slot.

FIG. 9 shows wall 64 supporting ceiling slab 66 with a bolt type connector engaging reinforcing bars extending thru access slot, and engaging pivot bar 71. The dividing line 68 between the sections is located a distance from wall 64 equal to about ¼ of the clear span of the ceiling slab in this area. This causes the ceiling slab over wall 64 to work as a continuous span slab. A temporary shore 73 supports the adjacent ceiling slab until a welded joint is completed along line 69. The fact that the adjacent slabs are cast together assures the fit in the erected position.

in FIG. 10. access slot 74A thru ceiling slab 74, is shown with a notch 75 out of the corner of wall 88 and a notch 76 out of the corner of wall 87. A flat bar type of connector 77 extends thru the access slot and is connected thru a slot opening by bolt 79 to plate 78 which is anchored by bar 80 to slab 87. Flat bar 77 is shown secured by bolts 87 to channel 83 which is cast integral with slab 74. Flat bar 77 is shown extending above slab 74 where it forms a stop for side of notch 75 with a plate 82 anchored into wall 88. Flat bar 77 and plate 82 may be welded to secure the joint. In addition, reinforcing bars 84 and 86, extend into notches 74 and 76, and they are spliced with bar 85 that may be welded to bars 86 and 84. Thus the access slot provides the means of providing for continuity between the walls of the building.

Figure 11:
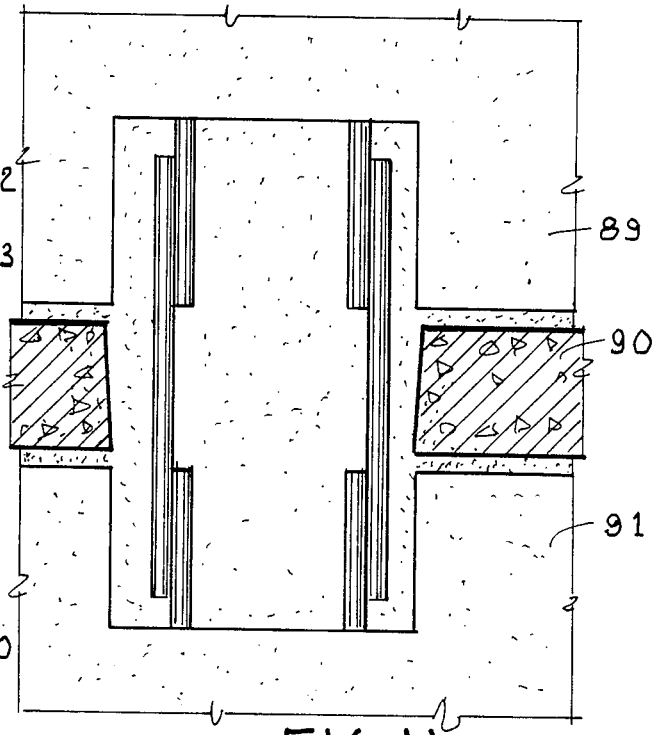
FIG. 11 shows an access slot used to develop shear block where no connection device is provided.

FIG. 11 discloses a longitudinal section of an access slot with walls 89 and 91 and ceiling slab 90. This illustrates the development of shear block effect which provides both vertical bearing and shear resistance for the structural design.

Figure 12:
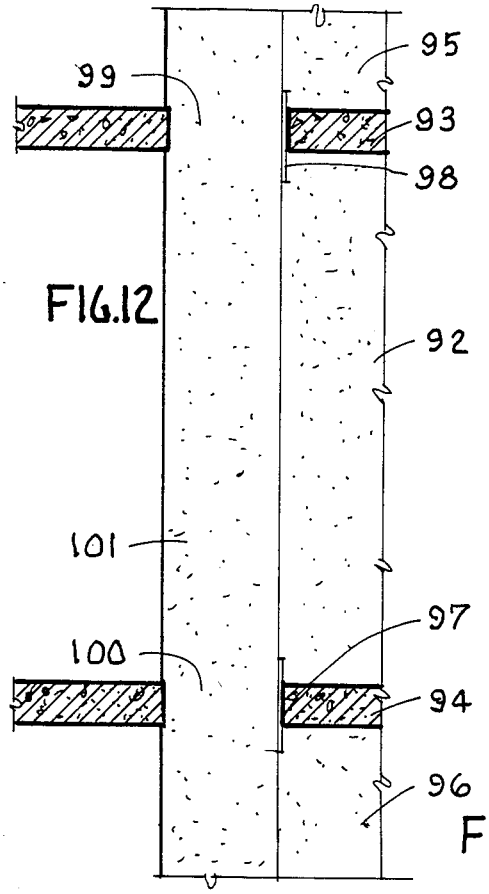
FIG. 12 discloses the hinged device at the ends of the wall and the access slot located beyond the end of the wall, with a cast in place column cast between the ceiling and the floor of the module, providing a vertical tie for the total building as well as a shear block for the structure.

FIG. 12, illustrates a connnecting device 98 similar to that in FIG. 10, except that the notches 76 and 75 are omitted so that the hinge device is at the end of the wall. Access slot 99 and 100 provide for a cast in place column 101 to be cast to provide complete continuity in vertical structure. Wall 92 can be cast with reinforcing bars extended to engage the column 101. This is similar to the ductile frame concept disclosed in now applied for patent Ser. No. 437,815 by the petitioner.

Figure 13:
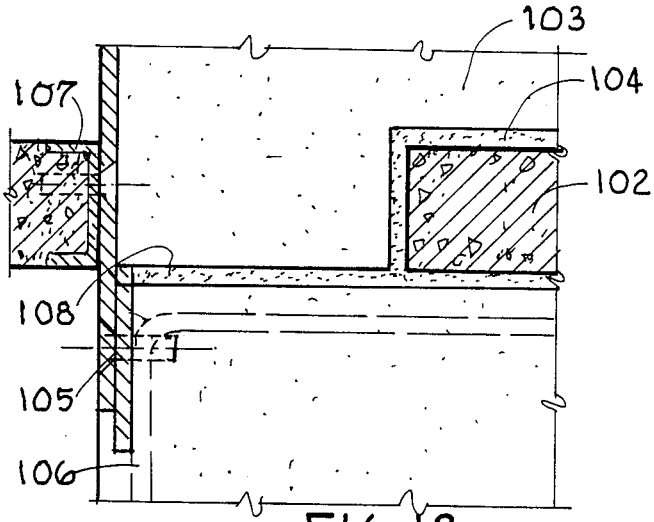
FIG. 13 discloses the connection device located at the end of the wall with the access slot provided within the footprint of the wall, and an extension of the wall above, fit down into the access slot.

FIG. 13 discloses a foot 103 cast with the wall above extending into the access slot cast in slab 102. The flat bar connection is shown with flat head screw 105 as pivot for the wall. Grout beds 104 and 108 provide the bearing of the wall.

Figure 14:
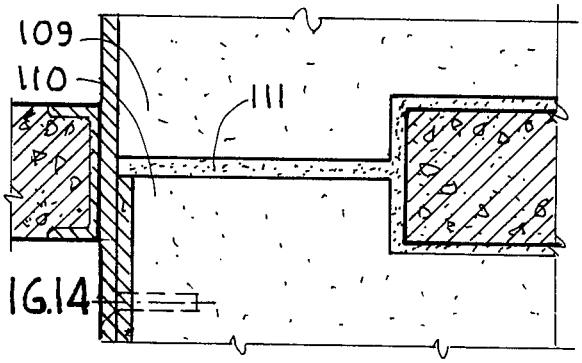
FIG. 14 shows another arrangement with the underlying wall shaped to provide an extension up into the slot.

FIG. 14 discloses a foot 109 bearing on extension 110, with the bearing surface 111 located at the mid depth of the ceiling slab.

This keying relationship of the walls into the access slot provides for the kind of connection required to secure the building together to avoid the failures that have occurred in England where heater explosions have caused collapse where no such keying was provided. In conclusion, advantages of the present invention may be summarized as follows:

1. Hinging hardware installed after units are cast.
2. Eliminates false forming.
3. Permits walls to be cast extending beyond building edge and across module lines.
4. Permits vertical modulation of floors for depressed balconies, bathrooms.
5. Utilizes gang type forming saving layout and materials and time.
6. Facilitates production of square edged walls.
7. Simplifies job organization with identical units cast on top of each other, and facilitates vertical alignment of cut outs for multiple floors.
8. Access slot permits direct transfer of vertical loads and shear loads.
9. Maximizes lifting capability of crane.
10. Reduces slab thickness thru continuous slab effect over bearing wall.
11. Permits close spacing of buildings with minimum site room.
12. Increases design freedom in planning for architect.
13. Permits wall slabs and ceiling slabs to be of different thicknesses.
14. Permits incorporation of cast in place columns sometimes needed to meet special loading or code requirements.

What is claimed is:

1. An improved method of constructing a foldably constructing building on a foundation floor, said method comprising the steps of:

A. forming and casting on site a series of wall slabs in horizontal position, each of said wall slabs having a hinge edge and a foot edge, and said walls are so arranged in the casting so that said hinge edges are positioned relative to each other in the same relationship that they will have in the erected building, and a connection means is embedded in each of said hinge edges at at least two spaced apart locations; and B. forming and casting on site at least one layer of ceiling slabs in a horizontal layer for entire floor of proposed building, and said ceiling slab is divided by division lines into a series of modular sections according to the lifting capability of the lifting apparatus, and in addition, said ceiling slabs are formed and cast with a series of access slots extending thru said ceiling slabs, and each of said slots comprises an opening almost equal in width to the thickness of said wall slabs, and length of said access slot equal to at least the thickness of said wall slabs, and each of said access slots is located in said ceiling slab according to the plan location of said walls in said proposed building, and according to the plan position of the said connection means embedded in said hinge edges of said walls, and C. positioning a section of said ceiling slabs on top of a group of said wall slabs, said group being the walls that are related to the ceiling section in the erected building, and positioning of said ceiling slab positions said access slots directly over said connection means, and D. inserting a connection device down thru said access slots to engage said connection means, said connection device being of the type that permits the hinge edge of said wall to pivot freely under the underside surface of said ceiling slab when said ceiling slab is elevated, and E. connecting said device to said connection means, and F. elevating said ceiling slab section and causing said hinge edges to be elevated simultaneously and causing said walls to depend to a vertical position forming a building module, and G. lifting said module into position over the section of said foundation floor where it is to be placed, and H. lowering said module into position causing said walls to bear upon said foundation floor, and I. lowering said ceiling slab to bear on said walls, and J. securing said walls to said foundation floor, and K. repeating steps C thru J to erect a complete building.

2. According to claim 1, with the addition of forming and casting more than one layer of said wall slabs with a bondbreaker under each of said layers, and in addition, forming and casting more than one layer of said ceiling slabs with a bondbreaker under each of said layers, and there are as many layers of said ceiling slabs and said wall slabs as there are storys of proposed building, and wherein, said ceiling slab of a first erected module comprises the floor foundation for the module erected thereon.

3. According to claim 2, wherein groups of said walls are cast in stacks with one layer of walls for each story of proposed building, and said groups are cast near said foundation floor, and, in addition, said ceiling slabs are cast in stacked array adjacent to said groups of said wall slabs, and said lifting apparatus lifts a top layer section of said ceiling slabs, and places it on top of a top layer of related group of said wall slabs, and said connector devices are inserted down through said access slots and engaged to said connection means, and module so assembled is elevated and placed into proposed building, and in addition, said lifting apparatus next lifts a second layer section of said ceiling slabs and assembles it with a second layer of group of said wall slabs, and erects said assembly on top of first said erected module, and there secures it, and the described sequence is repeated until the entire first stack of sections of ceiling slabs and related wall slabs have been erected, and the lifting apparatus then proceeds to relocate and erect a second stack of sections of ceiling sections together with related wall sections, and so on until the entire building is erected.

4. According to claim 1, with the additional step of forming and casting said walls with notches out out of the said hinge edge and said foot edge, said notches located to align with said access slots, and reinforcing bars from said walls are extended into said notches, and, after erection, steel splicing bars are inserted through said access slots and lapped onto said reinforcing bars, and secured thereto, and in addition, a form is placed over said notches, and said form is filled with concrete, and said form is removed and said formed concrete is finished.

5. According to claim 1, wherein said access slots are located within the footprint of said walls in the proposed building.

6. According to claim 1, wherein said access slots are located outside the end of the footprint of said walls, and said connector device is engaged to a connection means embedded in the end edge of said wall, and said connector device is secured to the end of said access slot.

7. According to claim 6, with the addition of forming and casting a column between floor and ceiling slab, adjacent to the end of said wall, and in addition, continuity reinforcing steel extending vertically thru said access slots.

8. According to claim 2, with the addition of constructing a casting platform on top of all but the first group of wall slabs to be lifted, said casting platform divided into sections according to the sections of said ceiling slabs, and casting over said casting platform, as many sections of ceiling slabs as possible, with extra sections cast adjacent thereto, and said sections of casting platform are removed in sequence to expose additional groups of wall slabs for erection.

9. According to claim 3, wherein said stacks are positioned in relation to said floor foundation of proposed building, so that lifting apparatus can from a single position (198 of FIG. 2, or 34A of FIG. 3, or 34B of FIG. 3, or 44 of FIG. 4) lift a section of said ceiling slab, position it on top of a related group of said wall slabs, where said connector devices are inserted and engaged, and lifting apparatus can continue to erect module so formed into proposed building structure.

10. According to claim 1, wherein said division line in said ceiling slabs is located at a quarter span point, and said ceiling slab is continuous over and erected wall slab, and in addition, adjacent sections of said ceiling slabs are supported on a common shore and there secured in even alignment.

11. According to claim 2, wherein all of said foundation floor, except the first section where the first module of the proposed building is to be erected, comprises a casting bed for said walls.

12. According to claim 3, wherein at least one section of said ceiling slabs is formed and cast in the nested configuration.

13. According to claim 3, wherein at least one stack of said walls is cast in the nested configuration.

14. According to claim 1 with the addition of a notch in the hinged edge of said wall slab, said notch located at the location of said connection means, and said connection means comprises a bar extending across said notch, and said bar is located at the mid depth of said wall.

15. According to claim 1, with the addition of an extension at the foot of said wall, said extension being of the size and shape to fit down into said access slot of the module below the said extension.

16. According to claim 1, with the addition of an extension of the said wall slab, said extension located on the hinge edge of said slab, and so located and of size and shape to fit partially up into said access slot in the erected position.

17. According to claim 4, with the addition of an extension to upper end of said connection device, and said extension comprises means of securing said connection device to an anchor plate embedded in the wall of the next above module.

* * * * *